US012753952B2

(12) United States Patent
Mancuso et al.

(10) Patent No.: US 12,753,952 B2
(45) Date of Patent: Oct. 6, 2026

(54) SYSTEM AND METHOD FOR DETECTION AND CORRECTION OF REVERSE FLOW IN AN EJECTOR REFRIGERATION CIRCUIT

(71) Applicant: Carrier Corporation, Palm Beach Gardens, FL (US)

(72) Inventors: Giulio Mancuso, Lyons (FR); Sascha Hellmann, Mainz-Kostheim (DE); Robert Kupski, Gdansk (PL); Adam Lasota, Gdansk (PL); Maik Oppermann, Mainz-Kostheim (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 196 days.

(21) Appl. No.: 18/739,714

(22) Filed: Jun. 11, 2024

(65) Prior Publication Data

US 2025/0085033 A1 Mar. 13, 2025

Related U.S. Application Data

(60) Provisional application No. 63/511,308, filed on Jun. 30, 2023.

(51) Int. Cl.
*F25B 9/08* (2006.01)

(52) U.S. Cl.
CPC ..... *F25B 9/08* (2013.01); *F25B 2341/0013* (2013.01); *F25B 2341/0015* (2013.01); *F25B 2600/2515* (2013.01); *F25B 2700/21175* (2013.01)

(58) Field of Classification Search
None
See application file for complete search history.

(56) References Cited

U.S. PATENT DOCUMENTS 11,365,915 B2 6/2022 Li et al.
11,454,409 B2 9/2022 Li et al.
11,460,124 B2 10/2022 Li et al.
(Continued)

FOREIGN PATENT DOCUMENTS

IN 386491 B 1/2022

OTHER PUBLICATIONS

Extended European Search Report received for EP Application No. 24185566.7, mailed on Nov. 14, 2024, 7 Pages.

*Primary Examiner* — Sean Shechtman
(74) *Attorney, Agent, or Firm* — Drew Folgmann

(57) ABSTRACT

A system for detection and correction of reverse flow in an ejector refrigeration circuit, includes ejectors, first sensors for measuring an ejector suction superheat of a refrigerant at a secondary low pressure input port of each of the ejectors, and a second sensor for measuring a superheat of the refrigerant upstream relative to the secondary low pressure input port. A controller receives the ejector suction superheats and the refrigerant superheat and determines whether a superheat difference between each of the ejector suction superheats and the refrigerant superheat falls below a threshold superheat difference. The controller identifies a first ejector as a reverse flow affected ejector based on the determined superheat difference. The controller compares opening percentages of the ejectors to determine a second ejector having the largest opening percentage and controls the first ejector and the second ejector to increase a refrigerant flow rate of the first ejector.

20 Claims, 4 Drawing Sheets

(56) References Cited

U.S. PATENT DOCUMENTS

| | | | | |
|---|---|---|---|---|
| 2007/0000262 | A1* | 1/2007 | Ikegami | F25B 41/00 62/170 |
| 2017/0248350 | A1 | 8/2017 | Liu et al. | |
| 2022/0299239 | A1 | 9/2022 | Zhu et al. | |

* cited by examiner

SYSTEM AND METHOD FOR DETECTION AND CORRECTION OF REVERSE FLOW IN AN EJECTOR REFRIGERATION CIRCUIT

CROSS REFERENCE TO RELATED APPLICATION

This application claims the benefit of U.S. Provisional Patent Application No. 63/511,308 filed on Jun. 30, 2023, which is incorporated by reference herein in its entirety.

FIELD OF THE INVENTION

The disclosure generally relates to ejector refrigeration circuits. More particularly, the disclosure relates to a system for detection and correction of reverse flow in an ejector refrigeration circuit.

BACKGROUND

Ejectors are sometimes used to improve overall efficiency of commercial refrigeration systems. The ejectors improve efficiency in the refrigeration system by utilizing a high pressure to help compress a low pressure gas, instead of relying solely on a compressor.

Typically, the ejectors may be located between an outlet of a condenser and an inlet of a receiver tank. The ejectors include a primary high pressure inlet, a secondary low pressure inlet, and an outlet. When an ejector is used as part of the refrigeration system, the cooled refrigerant from the heat exchanger enters each of the ejectors at the high pressure inlet and is expanded to a lower pressure at the outlet of each of the ejectors. At the outlet of the ejectors, the refrigerant flow will typically be both liquid and gaseous phase. The gaseous phase will be fed back to a compressor, while the liquid phase is fed through another expansion valve and then the evaporator. The fluid that leaves the evaporator then flows to the low pressure inlet of the ejector. The inclusion of the ejectors reduces a load on the compressor as the compressor can operate at a lower pressure difference and use less energy since the ejectors have partially compressed the refrigerant vapors to the intermediate pressure level.

However, when the ejectors are operated, if the high pressure fluid and the outlet fluid flow back to the secondary low pressure inlet, a large loss of compressor efficiency will result. Therefore, a reverse flow detection system that helps to detect a backflow or reverse flow of the refrigerant within the ejectors, is therefore desirable.

SUMMARY

This summary is provided to introduce a selection of concepts in a simplified format that are further described in the detailed description of the disclosure. This summary is not intended to identify key or essential inventive concepts of the disclosure, nor is it intended for determining the scope of the disclosure.

A system for detection and correction of reverse flow in an ejector refrigeration circuit, is disclosed. The system includes a plurality of ejectors, a plurality of first sensors, at least one second sensor, and a controller. Each of the plurality of ejectors include a primary high pressure input port, a secondary low pressure input port, and an output port. Each of the plurality of first sensors is adapted to measure an ejector suction superheat of a refrigerant at the secondary low pressure input port of a corresponding ejector from the plurality of ejectors. The at least one second sensor is located along a refrigerating evaporator flow path between at least one refrigerant evaporator and the secondary low pressure input port. The at least one second sensor is adapted to measure a superheat of the refrigerant upstream relative to the secondary low pressure input port. The controller is adapted to receive the ejector suction superheats measured by the plurality of first sensors and the refrigerant superheat measured by the at least one second sensor. The controller determines whether a superheat difference between each of the ejector suction superheats and the refrigerant superheat falls below a threshold superheat difference. The controller then identifies a first ejector from the plurality of ejectors as a reverse flow affected ejector based on the determined superheat difference.

Next, the controller determines a second ejector from the plurality of ejectors by comparing opening percentages of the plurality of ejectors, such that the second ejector includes the largest opening percentage. The controller increases the opening percentage of the first ejector and reduces the opening percentage of the second ejector to increase a refrigerant flow rate of the first ejector.

In one or more embodiments according to the disclosure, identifying the reverse flow affected ejector includes, in an order of priority, at least one of:

a) the controller identifying the first ejector from the plurality of ejectors as the reverse flow affected ejector if the determined superheat difference of only the first ejector falls below the threshold superheat difference;

b) the controller identifying an ejector that has a negative estimated suction flow from the plurality of ejectors as the reverse flow affected ejector if the determined superheat difference of more than one ejector from the plurality of ejectors falls below the threshold superheat difference;

c) the controller identifying a third ejector having the smallest opening percentage as the reverse flow affected ejector if the estimated suction flow of none or more than one ejector from the plurality of ejectors falls below zero.

In one or more embodiments according to the disclosure, if the determined superheat difference of more than one ejector from the plurality of ejectors falls below the threshold superheat difference, the controller is adapted to determine a third ejector and the second ejector from more than one ejector by comparing the opening percentages of more than one ejector having the superheat difference below the threshold superheat difference, such that the third ejector includes the smallest opening percentage and the second ejector includes the largest opening percentage. The controller identifies the third ejector having the smallest opening percentage from more than one ejector as a reverse flow affected ejector. Finally, the controller increases the opening percentage of the third ejector and reduces the opening percentage of the second ejector to increase a refrigerant flow rate of the third ejector.

In one or more embodiments according to the disclosure, each of the plurality of ejectors are controllable variable ejectors connected in a parallel configuration.

In one or more embodiments according to the disclosure, the plurality of ejectors have different capacities.

In one or more embodiments according to the disclosure, wherein the plurality of ejectors have throat sections of different diameters.

In one or more embodiments according to the disclosure, each of the plurality of ejectors are controllable variable ejectors with a flow valve upstream of the secondary low pressure input port.

In one or more embodiments according to the disclosure, the controller is adapted to open the flow valve to permit refrigerant flow and adapted to close the flow valve to prevent refrigerant flow.

In one or more embodiments according to the disclosure, the ejector refrigeration circuit includes a high pressure ejector circuit and a refrigerating evaporator flow path. The high pressure ejection circuit includes, in a direction of flow of a circulating refrigerant, a heat rejecting heat exchanger, the plurality of ejectors, a receiver, and at least one compressor. The refrigerating evaporator flow path includes, in the direction of flow of the circulating refrigerant, a liquid pump, at least one refrigeration expansion device, and at least one refrigerant evaporator. The heat rejecting heat exchanger includes an inlet side and an outlet side. Each of the plurality of ejectors include the primary high pressure input port, the secondary low pressure input port, and the output port, such that the primary high pressure input port is in fluid communication with the outlet side of the heat rejecting heat exchanger. The receiver includes an inlet, a liquid outlet, and a gas outlet, such that the inlet is in fluid communication with the output port of each of the plurality of ejectors. The at least one compressor includes an inlet side and an outlet side. The inlet side of the at least one compressor is in fluid communication with the gas outlet of the receiver and the outlet side of the at least one compressor is in fluid communication with the inlet side of the heat rejecting heat exchanger. The liquid pump includes an inlet side and an outlet side, such that the inlet side is in fluid communication with the liquid outlet of the receiver. The at least one refrigeration expansion device includes an inlet side and an outlet side, such that the inlet side of the at least one refrigeration expansion device is in fluid communication with the outlet side of the liquid pump. The at least one refrigeration evaporator includes an inlet side and an outlet side, such that the inlet side is in fluid communication with the outlet side of the at least one refrigeration expansion device and the outlet side is in fluid communication with the secondary low pressure input port of each of the plurality of ejectors.

In one or more embodiments according to the disclosure, the liquid pump includes a bypass-line having a switchable bypass valve for allowing refrigerant to selectively bypass the liquid pump by opening the switchable bypass valve.

A method for detection and correction of reverse flow in an ejector refrigeration circuit, is also disclosed. The method includes measuring, via each of a plurality of first sensors, an ejector suction superheat of a refrigerant at a secondary low pressure input port of a corresponding ejector from a plurality of ejectors. Next, at least one second sensor measures a superheat of the refrigerant upstream relative to the secondary low pressure input port. A controller receives the measured ejector suction superheats and the refrigerant superheat. The controller determines whether a superheat difference between each of the ejector suction superheats measured by the plurality of first sensors and the refrigerant superheat measured by the at least one second sensor falls below a threshold superheat difference. The controller identifies a first ejector from the plurality of ejectors as a reverse flow affected ejector based on the determined superheat difference of the first ejector. The controller determines a second ejector from the plurality of ejectors by comparing opening percentages of the plurality of ejectors, such that the second ejector has the largest opening percentage. Finally, the controller increases the opening percentage of the first ejector and reduces the opening percentage of the second ejector to increase a refrigerant flow rate of the first ejector.

In one or more embodiments according to the disclosure, the at least one second sensor is located along a refrigerating evaporator flow path between at least one refrigerant evaporator and the secondary low pressure input port.

In one or more embodiments according to the disclosure, each of the plurality of ejectors include a primary high pressure input port, the secondary low pressure input port, and an output port.

In one or more embodiments according to the disclosure, identifying the reverse flow affected ejector includes, in an order of priority, at least one of:

a) the controller identifying the first ejector from the plurality of ejectors as the reverse flow affected ejector if the determined superheat difference of only the first ejector falls below the threshold superheat difference;

b) the controller identifying an ejector that has a negative estimated suction flow from the plurality of ejectors as the reverse flow affected ejector if the determined superheat difference of more than one ejector from the plurality of ejectors falls below the threshold superheat difference;

c) the controller identifying a third ejector having the smallest opening percentage as the reverse flow affected ejector if the estimated suction flow of none or more than one ejector from the plurality of ejectors falls below zero.

In one or more embodiments according to the disclosure, if the determined superheat difference of more than one ejector from the plurality of ejectors falls below the threshold superheat difference, the controller is adapted to determine a third ejector and the second ejector from more than one ejector by comparing opening percentages of more than one ejector having the superheat difference below the threshold superheat difference, such that the third ejector has the smallest opening percentage and the second ejector has the largest opening percentage. The controller identifies the third ejector having the smallest opening percentage from more than one ejector as a reverse flow affected ejector. The controller increases the opening percentage of the third ejector and reduces the opening percentage of the second ejector to increase a refrigerant flow rate of the third ejector.

In one or more embodiments according to the disclosure, each of the plurality of ejectors are controllable variable ejectors connected in a parallel configuration.

In one or more embodiments according to the disclosure, the plurality of ejectors have different capacities.

In one or more embodiments according to the disclosure, the plurality of ejectors have throat sections of different diameters.

In one or more embodiments according to the disclosure, each of the plurality of ejectors are controllable variable ejectors with a flow valve upstream of the secondary low pressure input port.

In one or more embodiments according to the disclosure, the controller is adapted to open the flow valve to permit refrigerant flow and adapted to close the flow valve to prevent refrigerant flow.

In one or more embodiments according to the disclosure, the ejector refrigeration circuit includes a high pressure ejector circuit and a refrigerating evaporator flow path. The high pressure ejection circuit includes, in a direction of flow of a circulating refrigerant, a heat rejecting heat exchanger, the plurality of ejectors, a receiver, and at least one compressor. The heat rejecting heat exchanger includes an inlet side and an outlet side. Each of the plurality of ejectors include the primary high pressure input port, the secondary low pressure input port, and the output port, such that the primary high pressure input port is in fluid communication with the outlet side of the heat rejecting heat exchanger. The receiver includes an inlet, a liquid outlet, and a gas outlet, such that the inlet is in fluid communication with the output port of each of the plurality of ejectors. The at least one compressor includes an inlet side and an outlet side, such that the inlet side of the at least one compressor is in fluid communication with the gas outlet of the receiver and the outlet side of the at least one compressor is in fluid communication with the inlet side of the heat rejecting heat exchanger. The refrigerating evaporator flow path includes, in the direction of flow of the circulating refrigerant, a liquid pump, at least one refrigeration expansion device, and at least one refrigerant evaporator. The liquid pump includes an inlet side and an outlet side, such that the inlet side is in fluid communication with the liquid outlet of the receiver. The at least one refrigeration expansion device includes an inlet side and an outlet side, such that the inlet side of the at least one refrigeration expansion device is in fluid communication with the outlet side of the liquid pump. The at least one refrigeration evaporator includes an inlet side and an outlet side, such that the inlet side is in fluid communication with the outlet side of the at least one refrigeration expansion device and the outlet side is in fluid communication with the secondary low pressure input port of each of the plurality of ejectors.

In one or more embodiments according to the disclosure, the liquid pump includes a bypass-line having a switchable bypass valve allowing refrigerant to selectively bypass the liquid pump by opening the switchable bypass valve.

To further clarify the advantages and features of the methods, systems, and apparatuses, a more particular description of the methods, systems, and apparatuses will be rendered by reference to specific embodiments thereof, which are illustrated in the appended drawings. It is appreciated that these drawings depict only typical embodiments of the disclosure and are therefore not to be considered limiting of its scope. The disclosure will be described and explained with additional specificity and detail with the accompanying drawings.

BRIEF DESCRIPTION OF THE DRAWINGS

These and other features, aspects, and advantages of the disclosure will become better understood when the following detailed description is read with reference to the accompanying drawings in which like characters represent like parts throughout the drawings, wherein.

Figure 1:
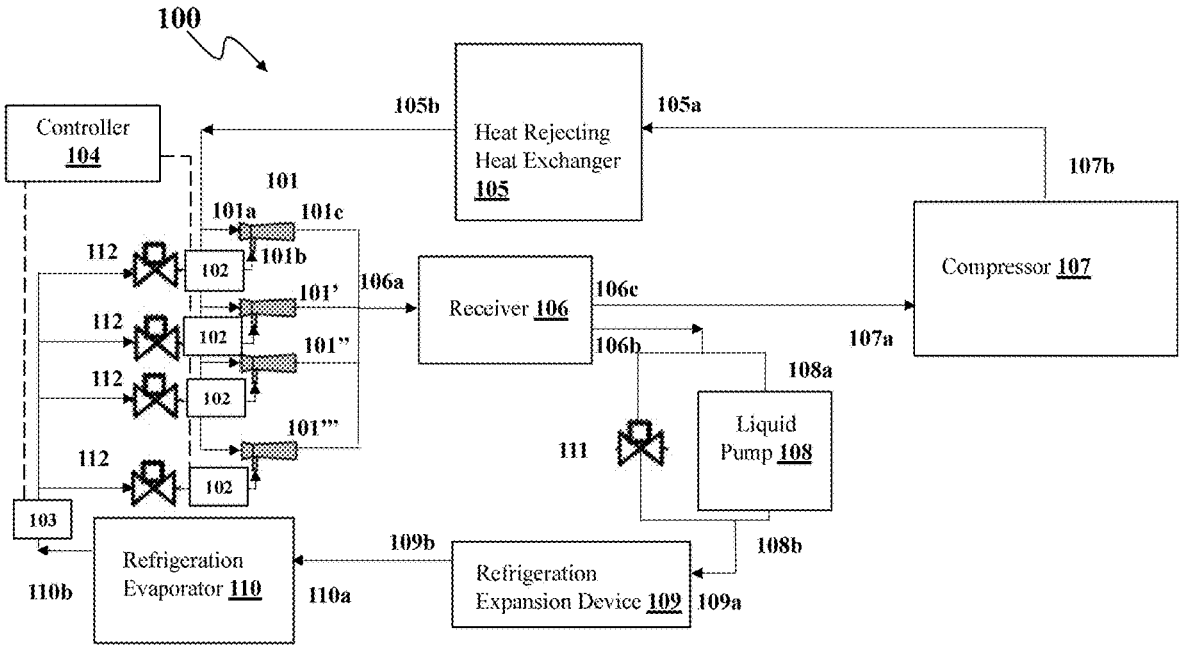
FIG. 1 exemplarily illustrates a schematic view of a system for detection and correction of reverse flow in an ejector refrigeration circuit according to one or more embodiments of the disclosure.

Further, skilled artisans will appreciate that elements in the drawings are illustrated for simplicity and may not have necessarily been drawn to scale. For example, the flow charts illustrate the method in terms of the most prominent steps involved to help to improve understanding of aspects of the disclosure. Furthermore, in terms of the construction of the device, one or more components of the device may have been represented in the drawings by conventional symbols, and the drawings may show only those specific details that are pertinent to understanding the embodiments of the disclosure so as not to obscure the drawings with details that will be readily apparent to those of ordinary skill in the art having the benefit of the description herein.

DETAILED DESCRIPTION

For the purpose of promoting an understanding of the principles of the disclosure, reference will now be made to the various embodiments and specific language will be used to describe the same. It will nevertheless be understood that no limitation of the scope of the disclosure is thereby intended, such alterations and further modifications in the illustrated system, and such further applications of the principles of the disclosure as illustrated therein being contemplated as would normally occur to one skilled in the art to which the disclosure relates.

It will be understood by those skilled in the art that the foregoing general description and the following detailed description are explanatory of the disclosure and are not intended to be restrictive thereof.

Reference throughout this specification to "an aspect", "another aspect" or similar language means that a particular feature, structure, or characteristic described in connection with the embodiment is included in at least one embodiment of the disclosure. Thus, appearances of the phrase "in an embodiment", "in another embodiment", "some embodiments", "one or more embodiments" and similar language throughout this specification may, but do not necessarily, all refer to the same embodiment.

The terms "comprises", "comprising", or any other variations thereof, are intended to cover a non-exclusive inclusion, such that a process or method that comprises a list of steps does not include only those steps but may include other steps not expressly listed or inherent to such process or method. Similarly, one or more devices or sub-systems or elements or structures or components proceeded by "comprises . . . a" does not, without more constraints, preclude the existence of other devices or other sub-systems or other elements or other structures or other components or additional devices or additional sub-systems or additional elements or additional structures or additional components.

Embodiments of the disclosure will be described below in detail with reference to the accompanying drawings.

FIG. 1 exemplarily illustrates a schematic view of a system 100 for detection and correction of reverse flow in an ejector refrigeration circuit according to one or more embodiments of the disclosure.

In an exemplary embodiment according to the disclosure, the ejector refrigeration circuit includes a high pressure ejector circuit including, in the direction of flow of a circulating refrigerant, a heat rejecting heat exchanger 105, a plurality of ejectors 101, a receiver 106, and at least one compressor 107. The ejector refrigeration circuit also includes a refrigerating evaporator flow path including, in the direction of flow of the circulating refrigerant, a liquid pump 108, at least one refrigeration expansion device 109, and at least one refrigeration evaporator 110.

The heat rejecting heat exchanger 105 includes an inlet side 105*a* and an outlet side 105*b*. The heat rejecting heat exchanger 105 may also be interchangeably referred to as a gas cooler unit or a condenser. The heat rejecting heat exchanger 105 is configured for transferring heat from the refrigerant to the environment thereby reducing the superheat of the refrigerant. In an embodiment, the heat rejecting heat exchanger 105 may include one or more fans for blowing air through the heat rejecting heat exchanger 105 to enhance the transfer of heat from the refrigerant to the environment. The type and number of the fans used may be adjusted based on the type of the condenser used, etc. The cooled refrigerant leaving the heat rejecting heat exchanger 105 at the outlet side 105*b* is delivered via a high pressure input line and an optional service valve to a primary high pressure input port 101*a* of the plurality of ejectors 101.

The plurality of ejectors 101 is adapted to expand the refrigerant to a reduced medium pressure level. Each of the plurality of ejectors 101 includes the primary high pressure input port 101*a*, a secondary low pressure input port 101*b*, and an output port 101*c*. The primary high pressure input port 101*a* is in fluid communication with the outlet side 105*b* of the heat rejecting heat exchanger 105. The expanded refrigerant leaves the ejectors 101 through a respective ejector output port 101*c* and is delivered to an inlet 106*a* of the receiver 106. Moreover, the receiver 106 includes a liquid outlet 106*b* and a gas outlet 106*c*, and the inlet 106*a* is in fluid communication with the output port 101*c* of each of the plurality of ejectors 101. Within the receiver 106, the refrigerant is separated by means of gravity into a liquid portion collecting at a bottom part of the receiver 106 and a gas phase portion collecting in an upper part of the receiver 106. The gas phase portion of the refrigerant leaves the receiver 106 through the gas outlet 106*c* provided at the upper part of the receiver 106 and is delivered to the inlet side 107*a* of the at least one compressor 107 completing the refrigerant cycle of the high pressure ejector circuit.

The at least one compressor 107 includes the inlet side 107*a* and an outlet side 107*b*. The inlet side 107*a* of the at least one compressor 107 is in fluid communication with the gas outlet 106*c* of the receiver 106 and the outlet side 107*b* of the at least one compressor 107 is in fluid communication with the inlet side 105*a* of the heat rejecting heat exchanger 105.

The liquid pump 108 includes an inlet side 108*a* and an outlet side 108*b*. The inlet side 108*a* is in fluid communication with the liquid outlet 106*b* of the receiver 106. In an embodiment, the liquid pump 108 may be located below the receiver 106. Arranging the liquid pump 108 below the receiver 106 allows using the forces of gravity for supplying the liquid refrigerant from the receiver 106 to the inlet side 108*a* of the liquid pump 108. The liquid pump 108 also includes a bypass-line including a switchable bypass valve 111 allowing refrigerant to selectively bypass the liquid pump 108 by opening the switchable bypass valve 111. In an embodiment, separate liquid pumps 108 and (optional) bypass-lines may be provided allowing to adjust the pressure of the liquid refrigerant independently.

The at least one refrigeration expansion device 109 includes an inlet side 109*a* and an outlet side 109*b*. The inlet side 109*a* of the at least one refrigeration expansion device 109 is in fluid communication with the outlet side 108*b* of the liquid pump 108. The at least one refrigeration evaporator 110 includes an inlet side 110*a* and an outlet side 110*b*. The inlet side 110*a* is in fluid communication with the outlet side 109*b* of the at least one refrigeration expansion device 109 and the outlet side 110*b* is in fluid communication with the secondary low pressure input port 101*b* of each of the plurality of ejectors 101.

The system 100 includes the plurality of ejectors 101, a plurality of first sensors 102, at least one second sensor 103, and a controller 104. Each of the plurality of ejectors 101 includes the primary high pressure input port 101*a*, the secondary low pressure input port 101*b*, and the output port 101*c*. In an embodiment, each of the plurality of ejectors 101 are controllable variable ejectors 101 as disclosed in the detailed description of FIG. 2. Hereinafter, the "ejector 101" may interchangeably be referred to as the "controllable variable ejector 101". Moreover, the plurality of ejectors 101 may be connected in parallel to each other or in a parallel configuration. The plurality of ejectors 101 may have different capacities or may all be of the same capacity. If the plurality of ejectors 101 used are controllable variable ejectors 101, the plurality of ejectors 101 may have opening percentages that are adjustable by actuating a needle 126, shown in FIGS. 2A-2B, of the plurality of ejectors 101 by the controller 104. As used herein, the term "opening percentage" is defined and described in detail in the detailed description of FIGS. 2A-2B. Alternatively, each of the plurality of ejectors 101 used may be controllable variable ejectors 101 with a flow valve 112 upstream of the secondary low pressure input port 101*b*. In an embodiment, the controller 104 is adapted to open the flow valve 112 to permit refrigerant flow and adapted to close the flow valve 112 to prevent refrigerant flow. In such an implementation, the controller 104 actuates the flow valve 112 between an ON and OFF position to permit or prevent a refrigerant flow towards the secondary low pressure input port 101*b* of the respective ejector 101.

Each of the plurality of first sensors 102 is adapted to measure an ejector suction superheat of a refrigerant at the secondary low pressure input port 101*b* of a corresponding ejector 101 from the plurality of ejectors 101. The at least one second sensor 103 is located along a refrigerating evaporator flow path between at least one refrigerant evaporator 110 and the secondary low pressure input port 101*b*. As such, the at least one second sensor 103 is adapted to measure a superheat of the refrigerant upstream relative to the secondary low pressure input port 101*b*. The controller 104 communicates with each of the plurality of first sensors 102 and the at least one second sensor 103.

As used herein, the term "superheat" refers to the increase of the temperature of a refrigerant vapor in comparison to the boiling point of the refrigerant at a given pressure. The boiling point of the refrigerant is different at different pressures. As the operating pressure of the system 100 changes, the boiling point of the refrigerant also changes. When the plurality of first sensors 102 measure the ejector suction superheat of the refrigerant at the secondary low pressure input port 101*b*, this means the plurality of first sensors 102 measures the difference between the temperature of the refrigerant vapor at the secondary low pressure input port 101*b* and the boiling point of the refrigerant at the current operating pressure of the system 100. Similarly, when the at least one second sensor 103 measures the superheat of the refrigerant upstream relative to the secondary low pressure input port 101*b*, this means the at least one second sensor 103 measures the difference between the temperature of the refrigerant vapor located upstream relative to the secondary low pressure input port 101*b* and the boiling point of the refrigerant at the current operating pressure of the system 100.

As used herein, the "controller 104" may be configured to control the at least one compressor 107, the liquid pump 108, the flow valves 112, and/or the plurality of ejectors 101 if at least one ejector 101 of the plurality of ejectors 101 are variable, based on one or more parameters, for example, a pressure value, a superheat value measured by the plurality of first sensors 102 and the at least one second sensor 103 for operating the ejector refrigeration circuit as efficiently as possible. In an embodiment, the controller 104 may refer to a single controller 104 or may be construed to encompass one or a combination of microprocessors, suitable logic, circuits, printed circuit boards (PCB), audio interfaces, visual interfaces, haptic interfaces, or the like. The controller 104 may include, but is not limited to, a microcontroller, a Reduced Instruction Set Computing (RISC) processor, an Application-Specific Integrated Circuit (ASIC) processor, a Complex Instruction Set Computing (CISC) processor, a central processing unit (CPU), a graphics processing unit (GPU), a state machine, and/or other processing units or circuits.

The controller 104 may also include suitable logic, circuits, interfaces, and/or code that may be configured to execute a set of instructions stored in a memory unit. In an exemplary implementation of the memory unit according to the disclosure, the memory unit may include, but is not limited to, Electrically Erasable Programmable Read-only Memory (EEPROM), Random Access Memory (RAM), Read Only Memory (ROM), Hard Disk Drive (HDD), Flash memory, Solid-State Drive (SSD), and/or CPU cache memory.

The controller 104 may also include a communication unit adapted to communicate with a computing device via a communication network. The communication unit may be configured of, for example, a telematic transceiver (DCM), a mayday battery, a GPS, a data communication module ASSY, a telephone microphone ASSY, and a telephone antenna ASSY. The communication network may include, but is not limited to, a Wide Area Network (WAN), a cellular network, such as a 3G, 4G, or 5G network, an Internet-based mobile ad hoc networks (IMANET), etc. The communication network may also include wired media such as a wired network or direct-wired connection, and wireless media such as acoustic, radio frequency (RF), microwave, infrared (IR) and other wireless media. In an embodiment, the computing device may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions.

In an exemplary embodiment, the controller 104 may receive power from a suitably coupled power source (not shown). For example, a battery or a power source may be electrically coupled to supply electrical power to the controller 104. In an embodiment, the power source may be, for example, a battery, such as a rechargeable battery or a non-rechargeable battery. Examples of suitable batteries include, for example, a lithium battery (such as a lithium-ion battery), a nickel battery (such as a nickel-cadmium battery), and an alkaline battery.

The controller 104 is adapted to receive the ejector suction superheats measured by the plurality of first sensors 102 and the refrigerant superheat measured by the at least one second sensor 103. Next, the controller 104 determines whether a superheat difference between each of the ejector suction superheats measured by the plurality of first sensors 102 and the refrigerant superheat measured by the at least one second sensor 103 falls below a threshold superheat difference. In an embodiment, the threshold superheat difference may be user defined, which means the threshold superheat difference may be set and adjusted or modified based on the performance or capacity of the ejector refrigeration circuit.

If the determined superheat difference of the first ejector 101' falls below the threshold superheat difference, the controller 104 identifies a first ejector 101' from the plurality of ejectors 101 as a reverse flow affected ejector. Next, the controller 104 determines a second ejector 101" from the plurality of ejectors 101 by comparing opening percentages of the plurality of ejectors 101 such that the second ejector 101" includes the largest opening percentage. It may be appreciated that the second ejector 101" is determined from the plurality of ejectors 101 excluding the identified first ejector 101'. Finally, the controller 104 increases the opening percentage of the first ejector 101' and reduces the opening percentage of the second ejector 101" simultaneously to increase a refrigerant flow rate of the first ejector 101'. The recovery step is performed by increasing the opening percentage of the first ejector 101' which is the reverse flow affected ejector 101 and simultaneously reducing the opening percentage of the second ejector 101" which has the largest opening percentage. The recovery step is performed until the superheat difference between the ejector suction superheats and the refrigerant superheat measured by the at least one second sensor 103 fall within the threshold superheat difference. The recovery step ensures a motive flow rate in the inlet 106*a* of the receiver 106 is kept constant while preventing maintaining the high pressure in the ejector refrigeration circuit.

The refrigerant superheat measured by the at least one second sensor 103 may be between 8K and 14K in nominal condition that is when the ejector 101 is not under reverse flow. As such, in the nominal condition shown in FIG. 2A, the ejector suction superheat of each of the ejectors 101 is a few Kelvin, for example, 1K, 2K, etc., higher than the refrigerant superheat measured by the at least one second sensor 103. Therefore, the threshold superheat difference between the ejector suction superheat and the refrigerant superheat may range between 4-5K. Alternatively, when the reverse flow occurs as shown in FIG. 2B, the threshold superheat difference falls below 4K and the ejector suction superheat of the reverse flow affected ejector 101 may go down to zero.

Alternatively, the condition of more than one ejector 101 having a superheat difference below the threshold superheat difference may occur. If the determined superheat difference of more than one ejector 101 from the plurality of ejectors 101 falls below the threshold superheat difference, the controller 104 is adapted to determine a third ejector 101''' and the second ejector 101" from more than one ejector 101 by comparing opening percentages of the more than one ejector 101 having the superheat difference below the threshold superheat difference such that the third ejector 101''' includes the smallest opening percentage and the second ejector 101" includes the largest opening percentage.

Referring to FIG. 1, if the determined superheat difference of the first ejector 101', the second ejector 101" and the third ejector 101''' fall below the threshold superheat difference, the controller 104 identifies an ejector (101', 101", or 101''') having a negative estimated suction flow (via a mathematical model) as the reverse flow affected ejector. If none of the plurality of ejectors 101 or if more than one ejector, for example, the first ejector 101', the second ejector 101", and the third ejector 101''' satisfy the condition of the negative estimated suction flow, the ejector with the smallest opening percentage is selected. For example, if the second ejector 101" has the largest opening percentage and the third ejector 101''' has the smallest opening percentage, the controller 104 identifies the third ejector 101''' as the reverse flow affected ejector.

From more than one ejector 101, the controller 104 proceeds to identify the third ejector 101''' having the smallest opening percentage as the reverse flow affected ejector 101. Finally, the controller 104 performs the recovery step by simultaneously increasing the opening percentage of the third ejector 101''' and reducing the opening percentage of the second ejector 101'' to increase a refrigerant flow rate of the third ejector 101'''. The recovery step is performed until the superheat difference between the ejector suction superheats and the refrigerant superheat measured by the at least one second sensor 103 fall within the threshold superheat difference.

In conclusion, an ejector is identified as the reverse flow affected ejector 101 by the controller 104 if at least one of the following conditions are satisfied in order of priority:

1) If the determined superheat difference of only one ejector, for example, the first ejector 101' falls below the threshold superheat difference, the controller 104 identifies the first ejector 101' from the plurality of ejectors 101 as the reverse flow affected ejector. The threshold superheat difference between the ejector suction superheat and the refrigerant superheat may range between 4-5K. Alternatively, when the reverse flow occurs as shown in FIG. 2B, the threshold superheat difference falls below 4K and the ejector suction superheat of the reverse flow affected ejector 101 may go down to zero.
2) If more than one ejector 101 from the plurality of ejectors 101 meets the above condition, the ejector that has a negative estimated (via mathematical model) suction flow is identified as the reverse flow affected ejector 101.
3) If none or more than one ejector 101 meet the previous condition, the ejector 101, for example, the third ejector 101''' with the smallest opening percentage is identified as the reverse flow affected ejector. This means, if the estimated suction flow of none or more than one ejector from the plurality of ejectors falls below zero, the third ejector 101''' with the smallest opening percentage is identified as the reverse flow affected ejector. Only one ejector can be identified as in reverse flow condition. Finally, the controller 104 performs the recovery step by simultaneously increasing the opening percentage of the third ejector 101''' and reducing the opening percentage of the second ejector 101'' to increase the refrigerant flow rate of the third ejector 101'''. The recovery step is performed until the superheat difference between the ejector suction superheats and the refrigerant superheat measured by the at least one second sensor 103 fall within the threshold superheat difference. By following this procedure an almost constant motive flow and high pressure is maintained. This minimizes the impact on the high pressure control loop.

Figure 2A:
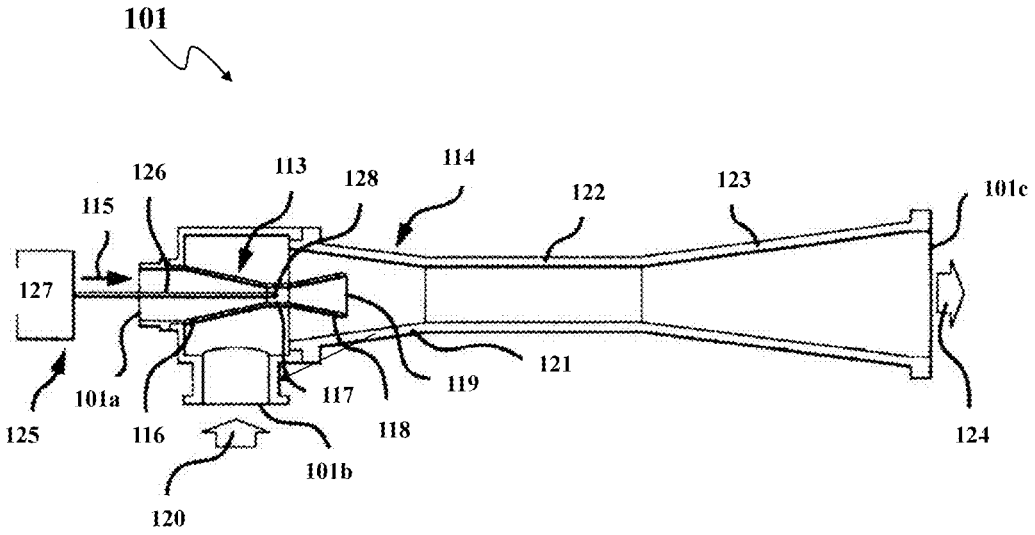
FIG. 2A exemplarily illustrates a schematic sectional view of a controllable ejector as it may be employed in the exemplary embodiment shown in FIG. 1.
Figure 2B:
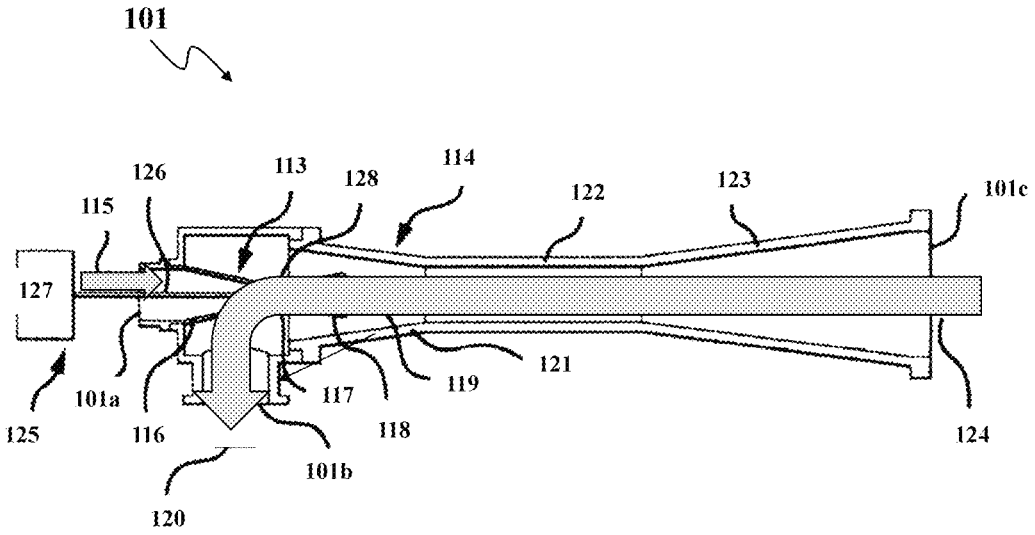
FIG. 2B exemplarily illustrates a schematic sectional view of the controllable ejector under a reverse flow condition.

FIG. 2A exemplarily illustrates a schematic sectional view of the controllable variable ejector 101 as it may be employed in the exemplary embodiment shown in FIG. 1. Each of the plurality of ejectors 101 includes the primary high pressure input port 101*a*, the secondary low pressure input port 101*b*, and the output port 101*c*. The ejector 101 is formed by a motive nozzle 113 nested within an outer member 114. The primary high pressure input port 101*a* forms the inlet to the motive nozzle 113. The outlet of the outer member 114 provides the output port 101*c* of the ejector 101. A primary refrigerant flow 115 enters the primary high pressure input port 101*a* and then passes into a convergent section 116 of the motive nozzle 113. The primary refrigerant flow 115 then passes through a throat section 117 and a divergent expansion section 118 to an outlet 119 of the motive nozzle 113. The motive nozzle 113 accelerates the primary refrigerant flow 115 and decreases the pressure of the primary refrigerant flow 115. The secondary low pressure input port 101*b* forms an inlet of the outer member 114. The pressure reduction caused to the primary flow by the motive nozzle 113 draws a secondary flow 120 into the outer member 114. The outer member 114 includes a mixer having a convergent section 121 and an elongate throat or mixing section 122. The outer member 114 also has a divergent section or diffuser 123 downstream of the elongate throat or mixing section 122. The outlet 119 of the motive nozzle 113 is positioned within the convergent section 121. As the primary refrigerant flow 115 exits the outlet 119, the primary refrigerant flow 115 begins to mix with the secondary flow 120 with further mixing occurring through the elongated throat or mixing section 122 which provides a mixing zone. Thus, respective primary and secondary flow paths respectively extend from the primary high pressure input port 101*a* and the secondary low pressure input port 101*b* to the output port 101*c*, merging at the exit.

In operation, the primary refrigerant flow 115 may be supercritical upon entering the controllable variable ejector 101 and subcritical upon exiting the motive nozzle 113. The secondary flow 120 may be gaseous or a mixture of gas with a smaller amount of liquid upon entering the secondary low pressure input port 101*b*. The resulting combined flow 124 is a liquid/vapor mixture and decelerates and recovers pressure in the diffuser 123 while remaining a mixture.

The controllability of the controllable variable ejector 101 is provided by a needle valve 125 having a needle 126 and an actuator 127. The actuator 127 is adapted to move a tip portion 128 of the needle 126 into and out of the throat section 117 of the motive nozzle 113 to modulate the primary refrigerant flow 115 through the motive nozzle 113 and, in turn, the controllable variable ejector 101 overall. In an embodiment, each of the plurality of ejectors 101 may have throat sections 117 having different diameters. Alternatively, each of the plurality of ejectors 101 may have throat sections 117 having equal diameters. As used throughout this document, the term "opening percentage" refers to the percentage of opening of the throat section 117. When the tip portion 128 of the needle 126 moves into the throat section 117, the opening percentage reduces to zero percent. Similarly, when the tip portion 128 moves completely out of the throat section 117, the opening percentage increases to 100 percent. Therefore, by actuating the tip portion of the needle 126 into and out of the throat section 117 of the motive nozzle 113, the opening percentage of the throat section 117 is controlled to range between 0-100 percent, such that the opening percentage of zero percent restricts the primary refrigerant flow 115 completely and the opening percentage of 100 percent allows the primary refrigerant flow 115 completely.

In an embodiment, the actuators 127 may be an electric actuator, for example, a solenoid or the like. The controller 104 disclosed in the detailed description of FIG. 1 may be coupled to the actuator 127 and other controllable components of the controllable variable ejector 101 using hardwired or wireless communication paths. The controller 104 may store a mathematical model to estimate the suction and motive flow rate. As such, the controller 104 may extract signals from sensors such as temperature sensors, pressure sensors, and the like to determine one or more parameters for use in the mathematical model. For example, the controller uses a motive Pressure, a motive temperature, a diameter of an Ejector needle opening, a diffuser Pressure, a Suction Pressure, etc., to estimate the suction flow rates and motive flow rates dynamically during operation. This allows the controller 104 to improve the accuracy of reverse flow detection.

FIG. 2B exemplarily illustrates a schematic sectional view of the controllable ejector 101 under a reverse flow condition. When affected by the reverse flow condition, the combined flow 124 is reversed and moves from the output port 101*c* to the secondary low pressure input port 101*b*. The combined flow 124 mixes with the primary refrigerant flow 115 and combines with the secondary flow 120 to exit through the secondary low pressure input port 101*b*.

Figure 3:
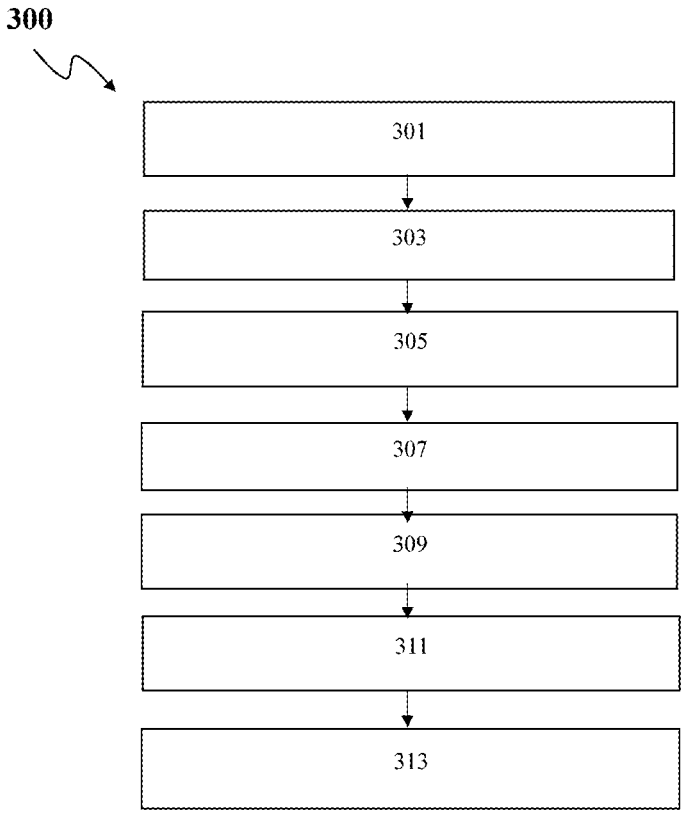
FIG. 3 exemplarily illustrates a flowchart indicating a method for detection and correction of reverse flow in the ejector refrigeration circuit.

FIG. 3 exemplarily illustrates a flowchart indicating a method 300 for detection and correction of reverse flow in the ejector refrigeration circuit. While the steps of FIG. 3 are shown and described in a particular sequence, the steps may occur in variations to the sequence in accordance with various embodiments of the disclosure. Further, the details related to various steps of FIG. 3, which are already covered in the description related to FIGS. 1-3 are not discussed again in detail here for the sake of brevity. The method 300 for detection and correction of reverse flow in an ejector refrigeration circuit, is disclosed.

At Step 301, each of the plurality of first sensors 102 measures the ejector suction superheat of the refrigerant at the secondary low pressure input port 101*b* of the corresponding ejector 101 from the plurality of ejectors 101. Each of the plurality of ejectors 101 includes the primary high pressure input port 101*a*, the secondary low pressure input port 101*b*, and the output port 101*c* as exemplarily illustrated in FIG. 2.

At Step 303, the at least one second sensor 103 measures the superheat of the refrigerant upstream relative to the secondary low pressure input port 101*b*. The at least one second sensor 103 is located along a refrigerating evaporator flow path between the at least one refrigerant evaporator 110 and the secondary low pressure input port 101*b*.

At Step 305, the controller 104 receives the ejector suction superheats measured by the plurality of first sensors 102 and the refrigerant superheat measured by the at least one second sensor 103.

At Step 307, the controller 104 determines whether a superheat difference between each of the ejector suction superheats measured by the plurality of first sensors 102 and the refrigerant superheat measured by the at least one second sensor 103 falls below a threshold superheat difference.

At Step 309, the controller 104 identifies a first ejector 101' from the plurality of ejectors 101 as a reverse flow affected ejector based on the determined superheat difference of the first ejector 101'.

Alternatively, the condition of more than one ejector 101 having the superheat difference below the threshold superheat difference may occur. If the determined superheat difference of more than one ejector 101 from the plurality of ejectors 101 falls below the threshold superheat difference, the controller 104 is adapted to determine a third ejector 101''' and the second ejector 101" from more than one ejector 101 by comparing opening percentages of the more than one ejector 101 having the superheat difference below the threshold superheat difference such that the third ejector 101''' includes the smallest opening percentage and the second ejector 101" includes the largest opening percentage. Since the third ejector 101''' has the smallest opening percentage, the controller 104 identifies the third ejector 101''' as the reverse flow affected ejector 101 from the more than one ejectors 101 having the superheat difference below the threshold superheat difference. It may be appreciated that the criteria for identifying the reverse flow affected ejector 101 is the smallest opening percentage. As such, the ejector 101 from among the more than one ejector 101 having the smallest opening percentage is identified as the reverse flow affected ejector 101. Finally, the controller 104 performs the recovery step by simultaneously increasing the opening percentage of the third ejector 101''' and reducing the opening percentage of the second ejector 101" to increase the refrigerant flow rate of the third ejector 101'''. The recovery step is performed until the superheat difference between the ejector suction superheats and the refrigerant superheat measured by the at least one second sensor 103 fall within the threshold superheat difference.

In conclusion, the identification of an ejector as the reverse flow affected ejector 101 by the controller 104 is satisfied based on the following conditions in order of priority:

1) If the determined superheat difference of only one ejector, for example, the first ejector 101' falls below the threshold superheat difference, the controller 104 identifies the first ejector 101' from the plurality of ejectors 101 as the reverse flow affected ejector. The threshold superheat difference between the ejector suction superheat and the refrigerant superheat may range between 4-5K. Alternatively, when the reverse flow occurs as shown in FIG. 2B, the threshold superheat difference falls below 4K and the ejector suction superheat of the reverse flow affected ejector 101 may go down to zero.
2) If more than one ejector 101 from the plurality of ejectors 101 meets the above condition, the ejector that has a negative estimated (via mathematical model) suction flow is identified as the reverse flow affected ejector 101.
3) If none or more than one ejector 101 meet the previous condition, the ejector 101, for example, the third ejector 101''' with the smallest opening percentage is identified as the reverse flow affected ejector. This means, if the estimated suction flow of none or more than one ejector from the plurality of ejectors falls below zero, the third ejector 101''' with the smallest opening percentage is identified as the reverse flow affected ejector. Only one ejector can be identified as in reverse flow condition. Finally, the controller 104 performs the recovery step by simultaneously increasing the opening percentage of the third ejector 101''' and reducing the opening percentage of the second ejector 101" to increase the refrigerant flow rate of the third ejector 101'''. The recovery step is performed until the superheat difference between the ejector suction superheats and the refrigerant superheat measured by the at least one second sensor 103 fall within the threshold superheat difference. By following this procedure an almost constant motive flow and high pressure is maintained. This minimizes the impact on the high pressure control loop.

At Step 311, the controller 104 determines a second ejector 101" from the plurality of ejectors 101 by comparing opening percentages of the plurality of ejectors 101, such that the second ejector 101" includes the largest opening percentage.

At Step 313, the controller increase the opening percentage of the first ejector 101' and reduces the opening percentage of the second ejector 101" to increase a refrigerant flow rate of the first ejector 101'.

Existing ejector control systems preset the ejectors 101 that can be used simultaneously. These preset opening configurations, for example, increasing the opening percentage of the first ejector 101' followed by reducing the opening percentage of the second ejector 101" and so on may be safe with regards to the reverse flow. However, by limiting the opening percentages to preset sequences, the ejector refrigeration circuit is prevented from reaching optimal performance. The dynamic detection of the reverse flow affected ejector 101 based on the determined superheat difference falling below the threshold superheat difference allows the controller 104 to proactively perform the recovery step. This feature helps optimize the overall efficiency of the ejector refrigeration circuit.

Existing algorithms detect the reverse flow by monitoring the ejector suction superheat of the ejectors approaching zero. The reaction time in such systems is slow since the reverse flow is detected when the reverse flow is already in a severe condition. The inclusion of the at least one second sensor 103 located along the refrigerating evaporator flow path between the at least one refrigerant evaporator 110 and the secondary low pressure input port 101*b*, allows measurement of the superheat of the refrigerant upstream relative to the secondary low pressure input port 101*b*. This feature allows the controller 104 to detect the reverse flow earlier when the ejector suction superheat of the ejector 101 is much above zero thereby reducing the recovery time and the performance loss.

Existing algorithms recover from the reverse flow by only opening the ejector 101 detected in reverse flow inducing an increased motive flow and a reduction of motive pressure. This affects the high pressure ejector circuit that tries to keep the high pressure within the system 100 to a predefined optimal value. The recovery step by which the controller 104 simultaneously reducing the opening percentage of the ejector 101 having the largest opening percentage among the plurality of ejectors 101 while increasing the opening percentage of the reverse flow affected ejector 101 reduces the impact on the high pressure ejector circuit by keeping the motive flow and high pressure almost constant.

While specific language has been used to describe the subject matter, any limitations arising on account thereto, are not intended. As would be apparent to a person in the art, various working modifications may be made to the method in order to implement the inventive concept as taught herein. The drawings and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment.

Without excluding further possible embodiments, certain example embodiments are summarized in the following clauses:

Clause 1: A method for detection and correction of reverse flow in an ejector refrigeration circuit, the method comprising: measuring, via each of a plurality of first sensors, an ejector suction superheat of a refrigerant at a secondary low pressure input port of a corresponding ejector from a plurality of ejectors; measuring, via at least one second sensor, a superheat of the refrigerant upstream relative to the secondary low pressure input port; receiving, via a controller, the measured ejector suction superheats and the refrigerant superheat; determining, via the controller, whether a superheat difference between each of the ejector suction superheats measured by the plurality of first sensors and the refrigerant superheat measured by the at least one second sensor falls below a threshold superheat difference; identifying, via the controller, a first ejector from the plurality of ejectors as a reverse flow affected ejector based on the determined superheat difference of the first ejector; determining, via the controller, a second ejector from the plurality of ejectors by comparing opening percentages of the plurality of ejectors, wherein the second ejector comprises the largest opening percentage; and increasing, via the controller, the opening percentage of the first ejector and reducing the opening percentage of the second ejector to increase a refrigerant flow rate of the first ejector.

Clause 2: The method of Clause 1, wherein the at least one second sensor is located along a refrigerating evaporator flow path between at least one refrigerant evaporator and the secondary low pressure input port.

Clause 3: The method of Clause 1, wherein each of the plurality of ejectors comprise a primary high pressure input port, the secondary low pressure input port, and an output port.

Clause 4: The method of Clause 1, wherein identifying the reverse flow affected ejector includes, in an order of priority, at least one of: the controller identifying the first ejector from the plurality of ejectors as the reverse flow affected ejector if the determined superheat difference of only the first ejector falls below the threshold superheat difference; the controller identifying an ejector that has a negative estimated suction flow from the plurality of ejectors as the reverse flow affected ejector if the determined superheat difference of more than one ejector from the plurality of ejectors falls below the threshold superheat difference; the controller identifying a third ejector having the smallest opening percentage as the reverse flow affected ejector if the estimated suction flow of none or more than one ejector from the plurality of ejectors falls below zero.

Clause 5: The method of Clause 1, wherein if the determined superheat difference of more than one ejector from the plurality of ejectors falls below the threshold superheat difference, the controller is adapted to: determine a third ejector and the second ejector from more than one ejector by comparing opening percentages of more than one ejector having the superheat difference below the threshold superheat difference, wherein the third ejector comprises the smallest opening percentage and the second ejector comprises the largest opening percentage; identify the third ejector comprising the smallest opening percentage from more than one ejector as a reverse flow affected ejector; and increase the opening percentage of the third ejector and reduce the opening percentage of the second ejector to increase a refrigerant flow rate of the third ejector.

Clause 6: The method of Clause 1, wherein each of the plurality of ejectors are controllable variable ejectors connected in a parallel configuration.

Clause 7: The method of claim 11, wherein the plurality of ejectors have different capacities.

Clause 8: The method of Clause 1, wherein the plurality of ejectors have throat sections of different diameters.

Clause 9: The method of Clause 1, wherein each of the plurality of ejectors are controllable variable ejectors with a flow valve upstream of the secondary low pressure input port.

Clause 10: The method of Clause 9, wherein the controller is adapted to open the flow valve to permit refrigerant flow and adapted to close the flow valve to prevent refrigerant flow.

Clause 11: The method of Clause 1, wherein the ejector refrigeration circuit comprises: a high pressure ejector circuit comprising in the direction of flow of a circulating refrigerant: a heat rejecting heat exchanger having an inlet side and an outlet side; the plurality of ejectors, each of the plurality of ejectors having the primary high pressure input port, the secondary low pressure input port, and the output port, wherein the primary high pressure input port is in fluid communication with the outlet side of the heat rejecting heat exchanger; a receiver, having an inlet, a liquid outlet, and a gas outlet, the inlet in fluid communication with the output port of each of the plurality of ejectors; at least one compressor having an inlet side and an outlet side, the inlet side of the at least one compressor in fluid communication with the gas outlet of the receiver and the outlet side of the at least one compressor in fluid communication with the inlet side of the heat rejecting heat exchanger; and a refrigerating evaporator flow path comprising in the direction of flow of the circulating refrigerant: a liquid pump having an inlet side and an outlet side, the inlet side in fluid communication with the liquid outlet of the receiver; at least one refrigeration expansion device having an inlet side and an outlet side, the inlet side of the at least one refrigeration expansion device in fluid communication with the outlet side of the liquid pump; and the at least one refrigeration evaporator having an inlet side and an outlet side, the inlet side in fluid communication with the outlet side of the at least one refrigeration expansion device and the outlet side in fluid communication with the secondary low pressure input port of each of the plurality of ejectors.

Clause 12: The method of Clause 1, wherein the liquid pump comprises a bypass-line including a switchable bypass valve allowing refrigerant to selectively bypass the liquid pump by opening the switchable bypass valve.

We claim:

1. A system for detection and correction of reverse flow in an ejector refrigeration circuit, the system comprising:

a plurality of ejectors, each of the plurality of ejectors having a primary high pressure input port, a secondary low pressure input port, and an output port;

a plurality of first sensors, each of the plurality of first sensors adapted to measure an ejector suction superheat of a refrigerant at the secondary low pressure input port of a corresponding ejector from the plurality of ejectors;

at least one second sensor located along a refrigerating evaporator flow path between at least one refrigerant evaporator and the secondary low pressure input port, the at least one second sensor adapted to measure a superheat of the refrigerant upstream relative to the secondary low pressure input port; and a controller adapted to:

receive the ejector suction superheats measured by the plurality of first sensors and the refrigerant superheat measured by the at least one second sensor;

determine whether a superheat difference between each of the ejector suction superheats and the refrigerant superheat falls below a threshold superheat difference;

identify a first ejector from the plurality of ejectors as a reverse flow affected ejector based on the determined superheat difference;

determine a second ejector from the plurality of ejectors by comparing opening percentages of the plurality of ejectors, wherein the second ejector comprises the largest opening percentage;

increase the opening percentage of the first ejector and reduce the opening percentage of the second ejector to increase a refrigerant flow rate of the first ejector.

2. The system of claim 1, wherein identifying the reverse flow affected ejector includes, in an order of priority, at least one of:

the controller identifying the first ejector from the plurality of ejectors as the reverse flow affected ejector if the determined superheat difference of only the first ejector falls below the threshold superheat difference;

the controller identifying an ejector that has a negative estimated suction flow from the plurality of ejectors as the reverse flow affected ejector if the determined superheat difference of more than one ejector from the plurality of ejectors falls below the threshold superheat difference;

the controller identifying a third ejector having the smallest opening percentage as the reverse flow affected ejector if the estimated suction flow of none or more than one ejector from the plurality of ejectors falls below zero.

3. The system of claim 1, wherein if the determined superheat difference of more than one ejector from the plurality of ejectors falls below the threshold superheat difference, the controller is adapted to:

determine a third ejector and the second ejector from more than one ejector by comparing the opening percentages of more than one ejector having the superheat difference below the threshold superheat difference, wherein the third ejector comprises the smallest opening percentage and the second ejector comprises the largest opening percentage;

identify the third ejector comprising the smallest opening percentage from more than one ejector as a reverse flow affected ejector; and increase the opening percentage of the third ejector and reduce the opening percentage of the second ejector to increase a refrigerant flow rate of the third ejector.

4. The system of claim 1, wherein each of the plurality of ejectors are controllable variable ejectors connected in a parallel configuration.

5. The system of claim 1, wherein the plurality of ejectors have different capacities.

6. The system of claim 1, wherein the plurality of ejectors have throat sections of different diameters.

7. The system of claim 1, wherein each of the plurality of ejectors are controllable variable ejectors with a flow valve upstream of the secondary low pressure input port.

8. The system of claim 7, wherein the controller is adapted to open the flow valve to permit refrigerant flow and adapted to close the flow valve to prevent refrigerant flow.

9. The system of claim 1, wherein the ejector refrigeration circuit comprises:

a high pressure ejector circuit comprising in a direction of flow of a circulating refrigerant:

a heat rejecting heat exchanger having an inlet side and an outlet side;

the plurality of ejectors, each of the plurality of ejectors having the primary high pressure input port, the secondary low pressure input port, and the output port, wherein the primary high pressure input port is in fluid communication with the outlet side of the heat rejecting heat exchanger;

a receiver, having an inlet, a liquid outlet, and a gas outlet, the inlet in fluid communication with the output port of each of the plurality of ejectors;

at least one compressor having an inlet side and an outlet side, the inlet side of the at least one compressor in fluid communication with the gas outlet of the receiver and the outlet side of the at least one compressor in fluid communication with the inlet side of the heat rejecting heat exchanger; and a refrigerating evaporator flow path comprising in the direction of flow of the circulating refrigerant:

a liquid pump having an inlet side and an outlet side, the inlet side in fluid communication with the liquid outlet of the receiver;

at least one refrigeration expansion device having an inlet side and an outlet side, the inlet side of the at least one refrigeration expansion device in fluid communication with the outlet side of the liquid pump; and the at least one refrigeration evaporator having an inlet side and an outlet side, the inlet side in fluid communication with the outlet side of the at least one refrigeration expansion device and the outlet side in fluid communication with the secondary low pressure input port of each of the plurality of ejectors.

10. The system of claim 9, wherein the liquid pump comprises a bypass-line having a switchable bypass valve for allowing refrigerant to selectively bypass the liquid pump by opening the switchable bypass valve.

11. A method for detection and correction of reverse flow in an ejector refrigeration circuit, the method comprising:

measuring, via each of a plurality of first sensors, an ejector suction superheat of a refrigerant at a secondary low pressure input port of a corresponding ejector from a plurality of ejectors;

measuring, via at least one second sensor, a superheat of the refrigerant upstream relative to the secondary low pressure input port;

receiving, via a controller, the measured ejector suction superheats and the refrigerant superheat;

determining, via the controller, whether a superheat difference between each of the ejector suction superheats measured by the plurality of first sensors and the refrigerant superheat measured by the at least one second sensor falls below a threshold superheat difference;

identifying, via the controller, a first ejector from the plurality of ejectors as a reverse flow affected ejector based on the determined superheat difference of the first ejector;

determining, via the controller, a second ejector from the plurality of ejectors by comparing opening percentages of the plurality of ejectors, wherein the second ejector comprises the largest opening percentage; and increasing, via the controller, the opening percentage of the first ejector and reducing the opening percentage of the second ejector to increase a refrigerant flow rate of the first ejector.

12. The method of claim 11, wherein the at least one second sensor is located along a refrigerating evaporator flow path between at least one refrigerant evaporator and the secondary low pressure input port.

13. The method of claim 11, wherein each of the plurality of ejectors comprise a primary high pressure input port, the secondary low pressure input port, and an output port.

14. The method of claim 11, wherein identifying the reverse flow affected ejector includes, in an order of priority, at least one of:

the controller identifying the first ejector from the plurality of ejectors as the reverse flow affected ejector if the determined superheat difference of only the first ejector falls below the threshold superheat difference;

the controller identifying an ejector that has a negative estimated suction flow from the plurality of ejectors as the reverse flow affected ejector if the determined superheat difference of more than one ejector from the plurality of ejectors falls below the threshold superheat difference;

the controller identifying a third ejector having the smallest opening percentage as the reverse flow affected ejector if the estimated suction flow of none or more than one ejector from the plurality of ejectors falls below zero.

15. The method of claim 11, wherein if the determined superheat difference of more than one ejector from the plurality of ejectors falls below the threshold superheat difference, the controller is adapted to:

determine a third ejector and the second ejector from more than one ejector by comparing opening percentages of more than one ejector having the superheat difference below the threshold superheat difference, wherein the third ejector comprises the smallest opening percentage and the second ejector comprises the largest opening percentage;

identify the third ejector comprising the smallest opening percentage from more than one ejector as a reverse flow affected ejector; and increase the opening percentage of the third ejector and reduce the opening percentage of the second ejector to increase a refrigerant flow rate of the third ejector.

16. The method of claim 11, wherein each of the plurality of ejectors are controllable variable ejectors connected in a parallel configuration.

17. The method of claim 11, wherein the plurality of ejectors have different capacities.

18. The method of claim 11, wherein the plurality of ejectors have throat sections of different diameters.

19. The method of claim 11, wherein each of the plurality of ejectors are controllable variable ejectors with a flow valve upstream of the secondary low pressure input port.

20. The method of claim 19, wherein the controller is adapted to open the flow valve to permit refrigerant flow and adapted to close the flow valve to prevent refrigerant flow.

* * * * *